US007513290B2

(12) United States Patent
Repp et al.

(10) Patent No.: US 7,513,290 B2
(45) Date of Patent: Apr. 7, 2009

(54) CORNICE

(75) Inventors: Jilene A. Repp, Hartland, WI (US); Francis A. Yogerst, West Bend, WI (US)

(73) Assignee: June Tailor, Inc., Richfield, WI (US)

( * ) Notice: Subject to any disclaimer, the term of this patent is extended or adjusted under 35 U.S.C. 154(b) by 0 days.

(21) Appl. No.: 11/786,554

(22) Filed: Apr. 12, 2007

(65) Prior Publication Data

US 2007/0193699 A1 Aug. 23, 2007

Related U.S. Application Data

(63) Continuation of application No. 10/828,835, filed on Apr. 21, 2004, now Pat. No. 7,216,686.

(60) Provisional application No. 60/464,509, filed on Apr. 22, 2003.

(51) Int. Cl.
*E06B 9/00* (2006.01)

(52) U.S. Cl. ..... 160/38; 160/39

(58) Field of Classification Search ..... 160/19, 160/38, 39, 395; 446/108, 106, 114
See application file for complete search history.

(56) References Cited

U.S. PATENT DOCUMENTS

| | | | | | |
|---|---|---|---|---|---|
| 1,009,469 | A | * | 11/1911 | Borrowes | 446/149 |
| 2,806,524 | A | * | 9/1957 | Klenz | 160/34 |
| 2,998,062 | A | | 8/1961 | Bixby | |
| 4,030,236 | A | * | 6/1977 | Schnabel | 446/128 |
| 4,246,951 | A | | 1/1981 | Givens | |
| 4,828,002 | A | | 5/1989 | Ashby | |
| 4,865,105 | A | | 9/1989 | Peters | |
| 4,966,218 | A | | 10/1990 | Peters | |
| 5,033,525 | A | | 7/1991 | Paeselt | |
| 5,039,049 | A | | 8/1991 | Niemi | |
| 5,042,548 | A | * | 8/1991 | Attal | 160/38 |
| 5,062,463 | A | | 11/1991 | Peters | |
| 5,152,331 | A | | 10/1992 | Barone | |
| 5,159,965 | A | | 11/1992 | Roy et al. | |
| 5,217,784 | A | | 6/1993 | Shepherd | |
| 5,345,990 | A | | 9/1994 | Potts | |
| 5,361,821 | A | | 11/1994 | Barone | |
| 5,383,635 | A | | 1/1995 | Barone | |
| 5,505,245 | A | | 4/1996 | Badalamenti | |
| 5,597,025 | A | | 1/1997 | Forkner | |
| D385,141 | S | | 10/1997 | Forkner | |
| 5,890,527 | A | | 4/1999 | Smiley et al. | |
| 5,918,435 | A | | 7/1999 | McGowen | |
| 5,927,362 | A | | 7/1999 | Smiley et al. | |
| 5,967,213 | A | | 10/1999 | Smiley et al. | |
| 6,032,433 | A | | 3/2000 | Hatziathanasiou | |
| 6,047,421 | A | | 4/2000 | Barone | |

(Continued)

*Primary Examiner*—Blair M. Johnson
(74) *Attorney, Agent, or Firm*—Foley & Lardner LLP

(57) ABSTRACT

A modular cornice system includes at least one substantially rigid face section and at least one substantially rigid return section having a connector configured to couple the return section and the face section. The system further includes at least one retainer on the face section configured to engage a bracket for attaching the cornice system to a mounting surface. An opening may be provided on the sections to receive a portion of a cover material, so that the cover material may be applied over at least a portion of the face section.

16 Claims, 7 Drawing Sheets

U.S. PATENT DOCUMENTS 6,152,204 A 11/2000 Santoro
6,167,939 B1 1/2001 Barone
6,173,752 B1 1/2001 Nelson et al.
6,205,936 B1 3/2001 Nelson et al.
D444,889 S 7/2001 Nelson et al.
6,315,026 B1 11/2001 Ross
6,718,721 B2 * 4/2004 Albany et al. ..... 52/588.1

* cited by examiner

FIGURE 3A
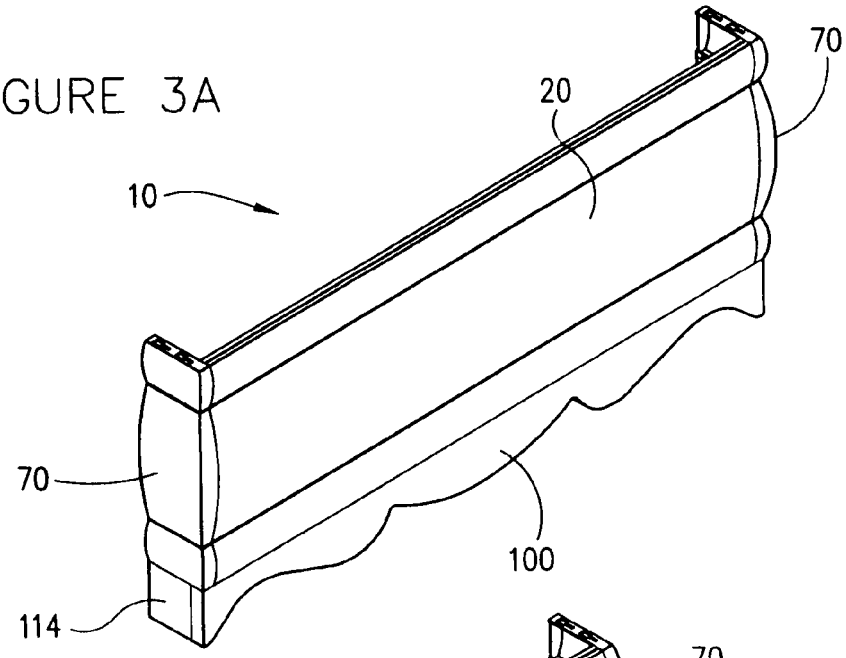
FIGURE 3B
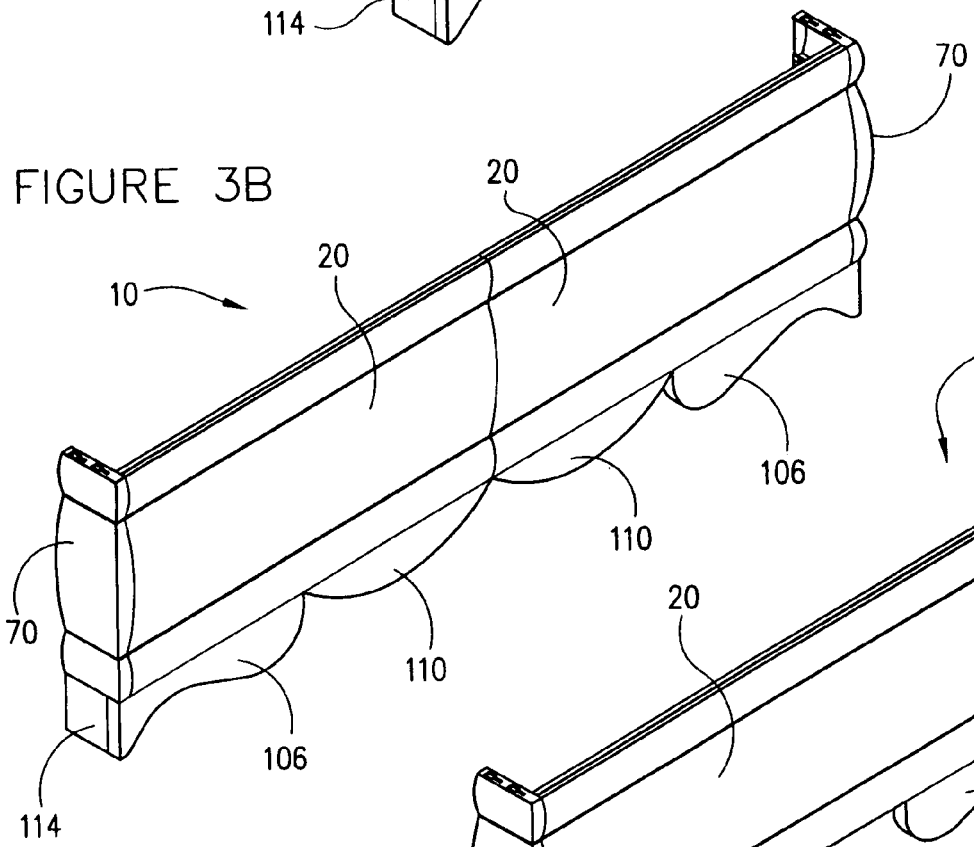
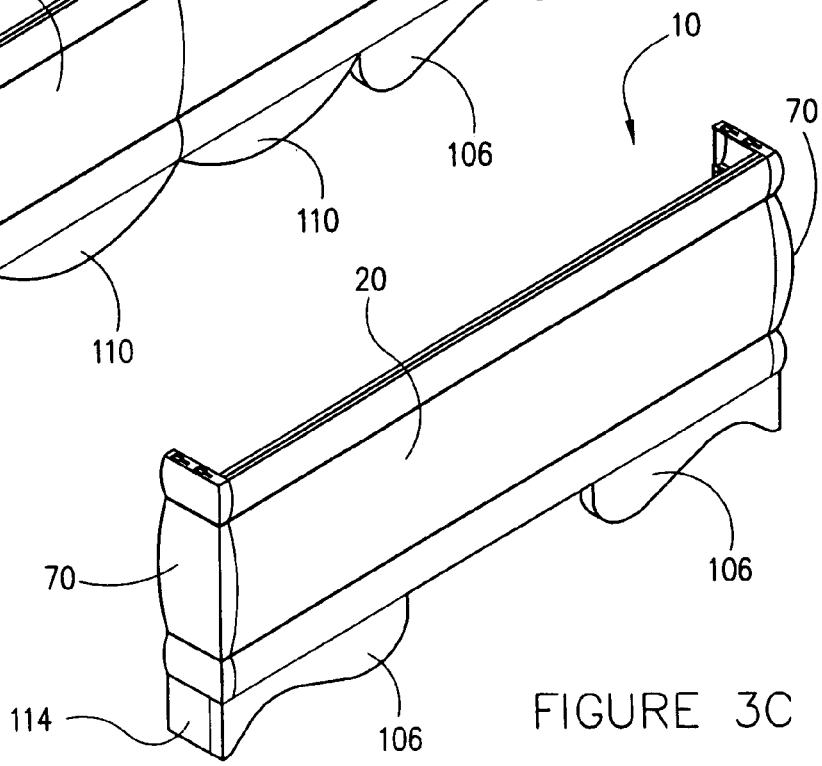
FIGURE 3C 10
46
46
140
142
20
60
48
50
50
82
14
34
34
38
84
40
42
36
36
112
70
144
48
76
82
86
70
116
82
88
84
124
118
108
114
72
20
80
88
50
36
14
76
50
82
112
34
34
38
116
48
114
60
42
36
44
124
108
118
7
60
48
8

FIGURE 7
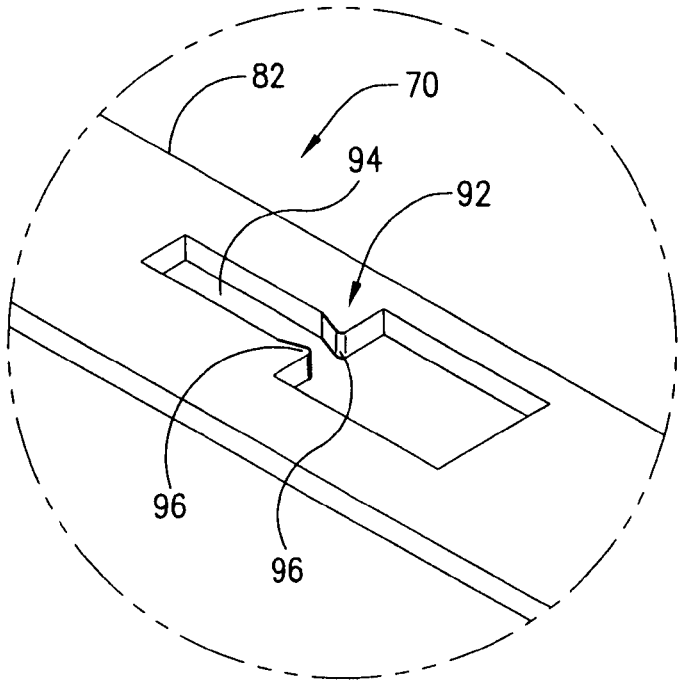
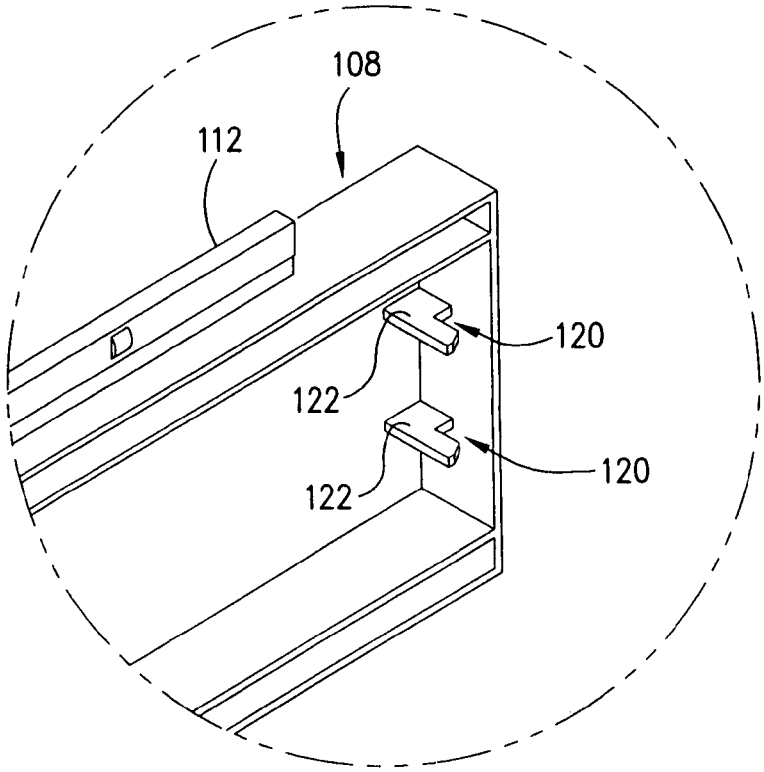
FIGURE 8

CORNICE

CROSS-REFERENCE TO RELATED APPLICATIONS

The present application claims the benefit of priority as a continuation application under 35 U.S.C. § 120 to U.S. patent application Ser. No. 10/828,835 titled "Cornice System" filed on Apr. 21, 2004, which claims the benefit of priority under 35 U.S.C. § 119(e)(1) to U.S. Provisional Patent Application No. 60/464,509 titled "Cornice System" filed on Apr. 22, 2003 (which are both incorporated by reference in their entirety).

FIELD

The present invention relate to a cornice. The present invention more specifically relate to a cornice for use with decorative treatments, such as cover materials. The present invention relates more particularly to a cornice having a modular form. The present invention relates more particularly to a cornice that can be conveniently assembled in a wide variety of configurations by a user.

BACKGROUND

It is generally known to provide a cornice that may be used within a space (such as a room, etc.) for decorative purposes or applications such as mounting window treatments or concealing window hardware such as curtain rods. The known cornices are typically formed from a wood foundation and include batting or the like attached to the wood foundation to provide a contoured surface, over which a cover fabric may be attached. The known cornices may also be made from a foam material (or the like) that includes one or more slots or incisions within which a cover material such as fabric can be tucked, or the material may be attached to the cornice by pins (or the like). Such cornices may also be provided in several sections that can be glued together to provide various lengths. However, such known cornices do not realize certain advantageous features (and/or combinations of features).

Accordingly, it would be desirable to provide a cornice or the like of a type disclosed in the present application that includes any one or more of these or other advantageous features:

1. A cornice that can be used as a decorative accessory in a variety of applications, such as window treatments, headboards, borders, trim members, etc.
2. A cornice that has return sections configured to extend to a base or mounting surface such as a wall, panel, divider, etc.
3. A cornice provided in modular form.
4. A cornice that provides flexibility to a user for configuring the cornice system in a variety of profiles or arrangements, such as varying lengths, widths, contours, shapes, sizes, and treatments.
5. A cornice that is lightweight.
6. A cornice that is configured to be conveniently assembled and installed by a user.
7. A cornice that is adaptable for use with, or without, a variety of cover materials or treatments, such as fabric, textiles, wallpaper, appliqués, paint, stain, etc.
8. A cornice that is adaptable for use with one or more of a combination of cover materials or treatments.
9. A cornice that is configured for interchanging a variety of cover materials or treatments.
10. A cornice that is commercially available as a kit.
11. A cornice having components with lengths that may be cut to suit.

12. A cornice that is configured for custom sizing, assembly, application of cover materials and installation by a user.
13. A cornice that is configured to be conveniently assembled and used and arranged so that it may have appeal to "do-it-yourself" type users.

Accordingly, it would be desirable to provide a cornice having any one or more of these or other advantageous features.

SUMMARY

The present invention relates to a cornice, which includes at least one substantially rigid and planar front section having a top edge and a bottom edge, with the front section having a back and an opposing face, and the face having at least one contoured surface. An accessory panel has a substantially planar portion and is connectable to at least one of the top edge and the bottom edge of the front section so that the substantially planar portion of the accessory panel extends co-planar from the front section.

The present invention also relates to a cornice, which includes at least one elongated and substantially rigid face section formed as a single and unitary piece. The face section has a front side and a back side, and a top edge and a bottom edge connecting the front side and the back side to form a continuous perimeter. At least one flap projects from the back side and extends substantially parallel to the back side to engage a mounting bracket. At least one substantially rigid return section has a connector configured to couple the return section and the face section. At least one slot extends at least partially along a length of the back side to provide access to an elongated recess that receives and retains a flexible cover material applied over at least a portion of the face section.

The present invention further relates to a cornice, which includes at least one elongated and substantially rigid first panel formed as a single and unitary extruded member. The first panel includes a front side, and a top edge and a bottom edge extending substantially perpendicular and rearward from the front side, and a first back edge extending substantially perpendicular and downward from the top edge, and a second back edge extending substantially perpendicular and upward from the bottom edge. The front side has a contoured surface which receives a flexible cover material. At least two second panels are coupled to opposite ends of the first panel. The second panels each have a front side and a top edge and a bottom edge, where the front side of the second panels have a contoured surface which receives a cover material.

The present invention further relates to a cornice, which includes at least one elongated first panel that is unitarily formed as an extruded substantially rigid foam member. The first panel has a front side, and a top edge and a bottom edge extending substantially perpendicular and rearward from the front side, the front side having a contoured surface. At least two second panels are coupled to opposite ends of the first panel. The second panels each have a front side and a top edge and a bottom edge, with the front side of the second panels having a contoured surface.

BRIEF DESCRIPTION OF THE DRAWINGS

FIG. 3A is a schematic representation of a front perspective view of a cornice system according to another embodiment.

FIG. 3B is a schematic representation of a front perspective view of a cornice system according to another embodiment.

FIG. 3C is a schematic representation of a front perspective view of a cornice system according to another embodiment.

FIG. 7 is a schematic representation of a detail view of a portion of a cornice system as shown in FIG. 4.

FIG. 8 is a schematic representation of a detail view of a portion of a cornice system as shown in FIG. 4.

DETAILED DESCRIPTION

Figure 1:
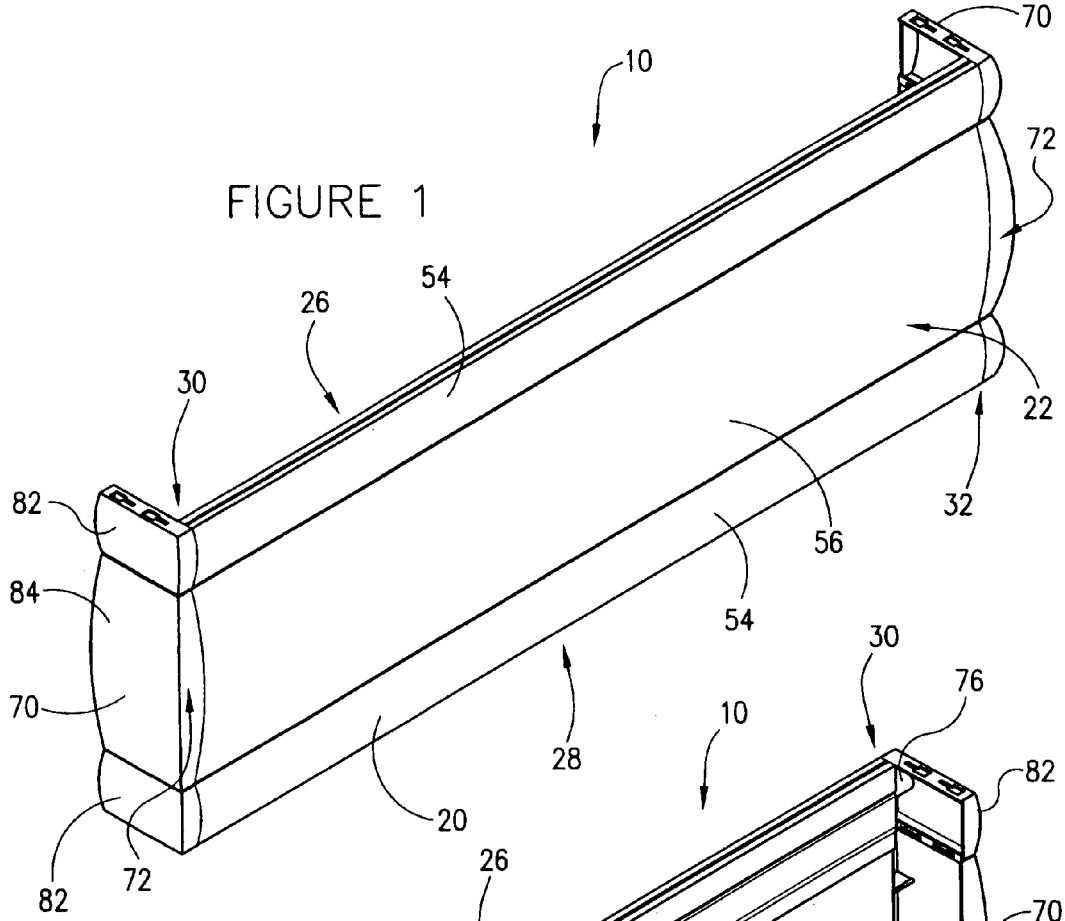
FIG. 1 is a schematic representation of a front perspective view of a cornice system according to an embodiment.

According to any exemplary embodiment, the cornice can be configured for use in a wide variety of decorating or accessory applications (e.g. window covering, cornice, valance, borders, frameworks, headboards, etc.). The cornice may also be used in combination with other accessories such as separate window treatments, or may be a part of a window treatment by attaching accessories, such as swags, shear curtains, or other accessories that are configured to hang (or otherwise supported) from the cornice and/or by application of a cover material such as paint, stain, wallpaper, fabric, material, or other trim, décor or treatment.

Referring to the FIGURES, the cornice provides a modular structure formed of various members (shown schematically as segments or sections in the form of one or more face sections and return sections) that are relatively rigid and can be assembled in a wide variety of configurations according to any exemplary embodiment. The members can be made from a variety of materials and provided with various profiles (e.g. surface shapes and contours), and in a variety of sizes (e.g. lengths, widths and thicknesses, etc.). The members are configured to allow convenient assembly of the cornice system by interconnection of the members into a desired structure to suit a particular application of a user. The members may be interconnected in a wide variety of configurations (e.g. by providing square or mitered ends on the members and suitable coupling members or connectors, etc.) that are intended to interchangeably engage the ends of the members for attachment of adjacent ends of the members. The variety of sizes of the members and the use of various connectors is intended to provide a cornice that has modularity to permit customization and adaptation to a wide variety of applications (e.g. appearance, size, location, accessories, etc.).

According to any exemplary embodiment, the members are also configured for attachment of treatments such as one or more cover materials (e.g. fabrics, textiles, wall paper, appliqués, or coatings such as stain, paint, etc.) to provide a decorative system that is easily and conveniently assembled or prepared by a user (such as a do-it-yourself type consumer, home improvement or decorating enthusiast, people who enjoy crafting, or commercial professionals, design agencies, etc.). The coatings may include any desired surface finish (e.g. glossy, matte, or textured such as a terra-cotta type paint or the like, etc.) The cornice is also intended to be easily and conveniently mounted or attached to a base or mounting surface (such as a wall, panel, partition, divider, etc.—not shown) by a mounting member (e.g. slot, groove, overlap, flap, etc.) formed on the section(s) and a holder (such as a bracket, hanger, hook, hardware, etc.). The mounting member is intended to provide flexibility in the installation of the cornice system by permitting convenient adjustment of the cornice relative to the bracket and the wall.

Figure 2:
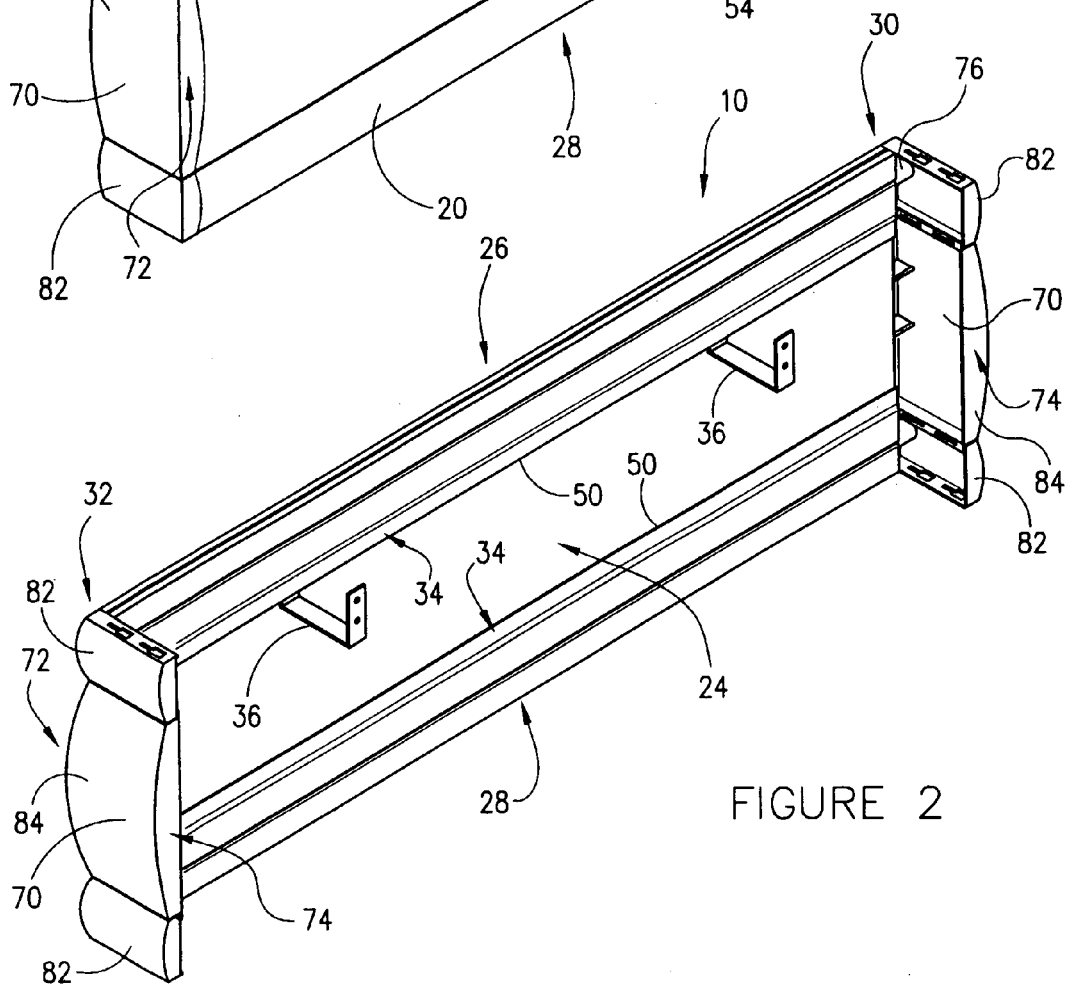
FIG. 2 is a schematic representation of a rear perspective view of a cornice system according to an embodiment.
Figure 3D:
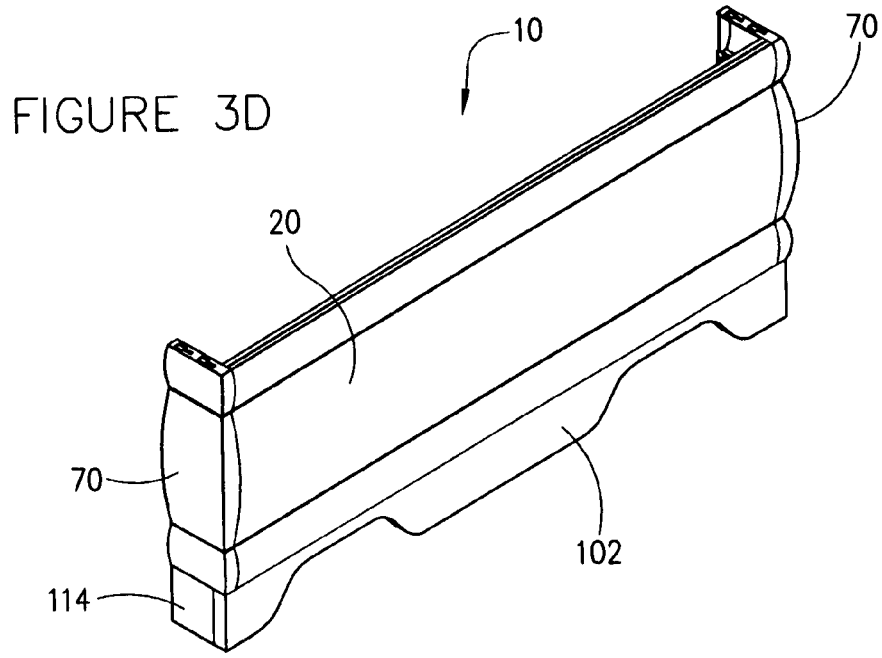
FIG. 3D is a schematic representation of a front perspective view of a cornice system according to another embodiment.
Figure 3E:
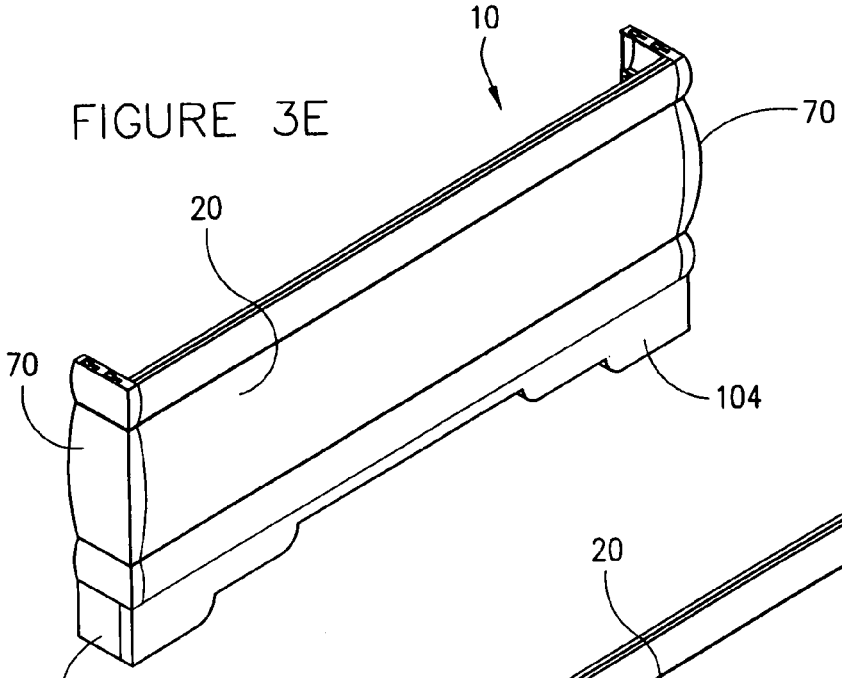
FIG. 3E is a schematic representation of a front perspective view of a cornice system according to another embodiment.
Figure 3F:
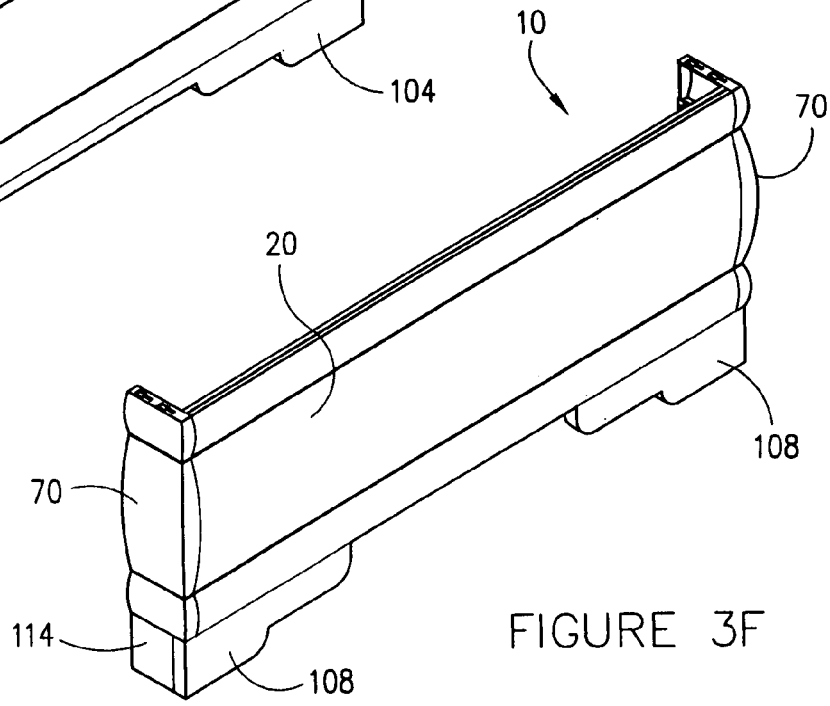
FIG. 3F is a schematic representation of a front perspective view of a cornice system according to another embodiment.
Figure 4:
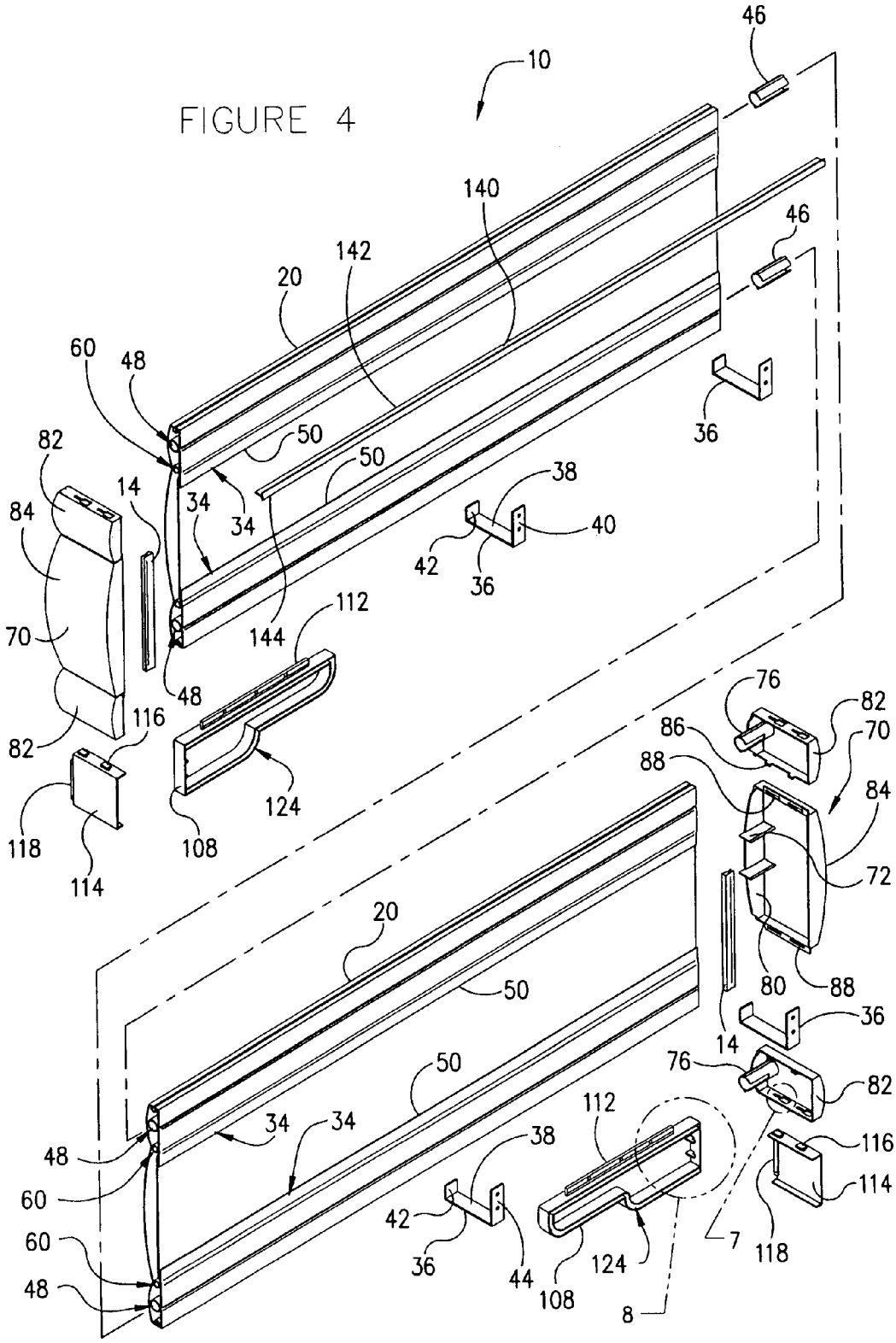
FIG. 4 is a schematic representation of a rear exploded perspective view of a cornice system according to an embodiment.

Referring to FIGS. 1, 2 and 4, a cornice 10 is shown as a modular assembly including face sections 20 (e.g. face panels, front panels, etc.—such as may be configured in a generally parallel orientation to the mounting surface) and return sections 70 (e.g. side panels, end panels, etc.—such as may be configured in a generally perpendicular orientation to the mounting surface) according to an exemplary embodiment. The modularity of cornice 10 is intended to provide flexibility for use in a wide variety of applications, and adaptability by a user to any desired decorating scheme.

Face sections 20 are shown schematically as a substantially rigid, hollow member (e.g. shell, extrusion, etc.—shown more particularly in FIGS. 5 and 6) having a generally rectangular shape with a front 22, a back 24, a top 26, a bottom 28 and ends 30 and 32. According to one exemplary embodiment, the face sections are provided in "standard" lengths (such as approximately 36 inches, 18 inches and 12 inches), but may be provided in any lengths by suitable machine-cutting during production of the sections. According to another exemplary embodiment, the face sections are provided in "extended" lengths (e.g. 8 feet, 12 feet, etc.) that may be "cut-to-size" by request from a consumer at a store such as home-improvement type store. Ends 30, 32 of each face section 20 are shown having a generally "flat" surface for connecting with return sections 70. According to an alternative embodiment, the ends of the face section may be mitered (e.g. at a 45 degree angle, or any other suitable angle, such as for use with "bay" windows for example, or other desired applications) so that the sections can be interconnected in a mitered joint to form a desired length, shape or configuration. According to one embodiment, the height of the face sections and return sections is approximately 12 inches, but may be provided in any suitable height. According to an alternative embodiment, the face and return sections may be "stacked" or otherwise configured one atop another to suit custom design applications.

The back 24 of face sections 20 are shown to include at least one mounting member (shown schematically in FIGS. 4-6 as two retainers 34 in the shape of elongated channels or pockets integrally formed in the back of the face section) and configured to engage a bracket (shown schematically as a generally L-shaped bracket 36, or the like) made of metal, plastic or other suitable material that may be secured to the wall by screws (such as drywall screws, wood screws or the like) or other fasteners of a conventional type. The retainers are configured to be movable over the brackets when the brackets are attached to the wall so that a user may conveniently reposition, remove and/or reinstall the cornice system (e.g. by "lifting" the face section from the bracket or "sliding" the face section over the bracket, etc.). Brackets 36 are shown as having a base section 38 with a length suited for positioning the face section a desired distance from the wall and so that the second end of the return sections are positioned in close proximity to the wall. Accordingly, brackets 36 and return sections 70 are intended to have coordinated (e.g.

"matching") lengths that may be provided in various coordinated lengths to suit different installation locations and applications. A first leg 40 extends from a first side of base 38 and is configured for attachment to the mounting surface (e.g. wall, etc.) using conventional fasteners (not shown). A second leg 42 extends from a second end of base 38 and is configured to engage retainer 34 on back 24 of face section 20 to mount the cornice to the mounting surface.

The return sections may be provided in various lengths adapted to position the face sections over other trim or decorative devices (e.g. curtain rods, window trim, window shades, etc.—not shown). According to the embodiment shown schematically in FIGS. 1 and 2, return sections 70 have a first end 72 having a profile intended to substantially "match" the profile of face section 20, and a second end 74 that is substantially "flat" and configured to abut the wall. The first end includes coupling members (shown schematically in FIG. 9 for example as integrally formed connectors 76 configured to "fit" over corresponding structure at the ends 30, 32 of the face section(s). First end 72 of return section is further shown to include tabs 78, 80 configured to "fit" within the hollow interior of end 30 or end 32 of face section 20 and are intended to help maintain the contour of front 22 of face section 20 at the joint locations. The return sections are shown schematically as being formed from separate pieces (shown for example as three separate pieces 82 and 84 in FIG. 4) configured to be interconnected to form the return section. Interconnection of the separate pieces may be accomplished in any suitable manner, such as tab-and-slot connectors (shown schematically for example as tabs 86 and slots 88) intended to provide an interference-type fit. According to a preferred embodiment, the tabs and slots are located to provide a relatively small gap 90 (shown more particularly in FIG. 9) between each of the separate pieces and is intended t to provide a space for retention of a cover material. The width of the gaps may be varied to suit any particular application, such as thickness of a cover material intended for use with the return section, etc. According to an alternative embodiment, the return sections may also be provided as a single, integrally formed piece made in a suitable operation (e.g. extrusion, molding, etc.). According to another alternative embodiment, the sections of the cornice system may be provided in an extendable or retractable configuration (e.g. telescoping, etc.) so that a user may configure the section in a desired length by extending or retracting one portion of the section relative to another portion of the section.

Figure 9:
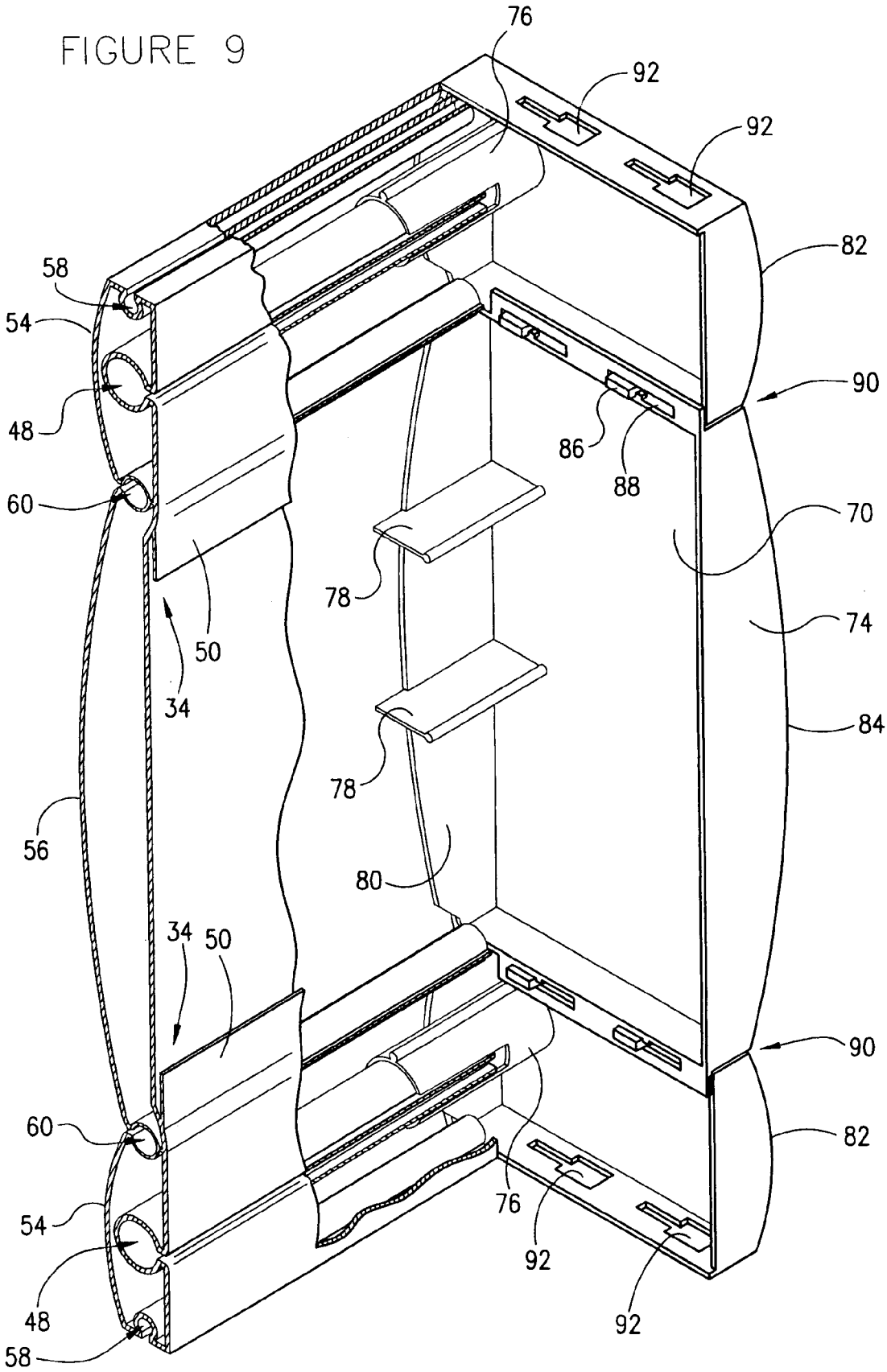
FIG. 9 is a schematic representation of a partial cut-away perspective view of a portion of a cornice system.

Referring to FIGS. 4 and 9, the face sections and return sections of the cornice may be interconnected (e.g. joined, coupled together, attached, etc.) using coupling members (shown schematically as, for example, face section connectors 46, and return section connectors 76) so that the length of a face section may be changed by "adding-on" or removing other face sections. According to one embodiment, face section connector 46 is shown as a generally cylindrical member having a slot or opening and made from a relatively thin section of material (e.g. plastic, aluminum, etc.) that are configured to engage the structure of openings 48 on face section 20 (e.g. by sliding interference fit, frictional fit, snap-fit, etc.). Return section connectors 76 are intended to interconnect the return sections with the ends of the face section(s). Connectors 76 are shown as a generally cylindrical member having a slot or opening and made from a relatively thin section of material (e.g. plastic, aluminum, etc.) that may be integrally formed on an internal surface of return section 70 and intended to engage the structure of openings 48 in face section 20 (shown more particularly in FIG. 9).

According to an alternative embodiment, the return section may have an opening (similar to opening 48 on the face section) and a removable connector (similar to connector 46) may be provided to interconnect the face and return sections by engaging the structure around the openings on the face and return sections. According to another alternative embodiment, the connectors may be configured to interconnect abutting ends of the sections that have been mitered (e.g. by interference fit, frictional fit, snap-fit, etc.). Such connectors may have an angle of approximately 90 degrees, but may also have any desired angle for configuring the sections into an assembled cornice adapted for use with any particular application.

The connectors are intended to join a desired combination of face and/or return sections into a particular configuration desired by a user. According to an alternative embodiment, the sections of the cornice may also be coupled using other devices such as rods or dowels that extend in "pockets" that are provided in the sections. According to another alternative embodiment, the return sections may interconnect to the straight sections in a "picture-frame" like manner and may be mounted flush with a mounting surface or wall for use in applications such as headboards, framing, etc.

Figure 5:
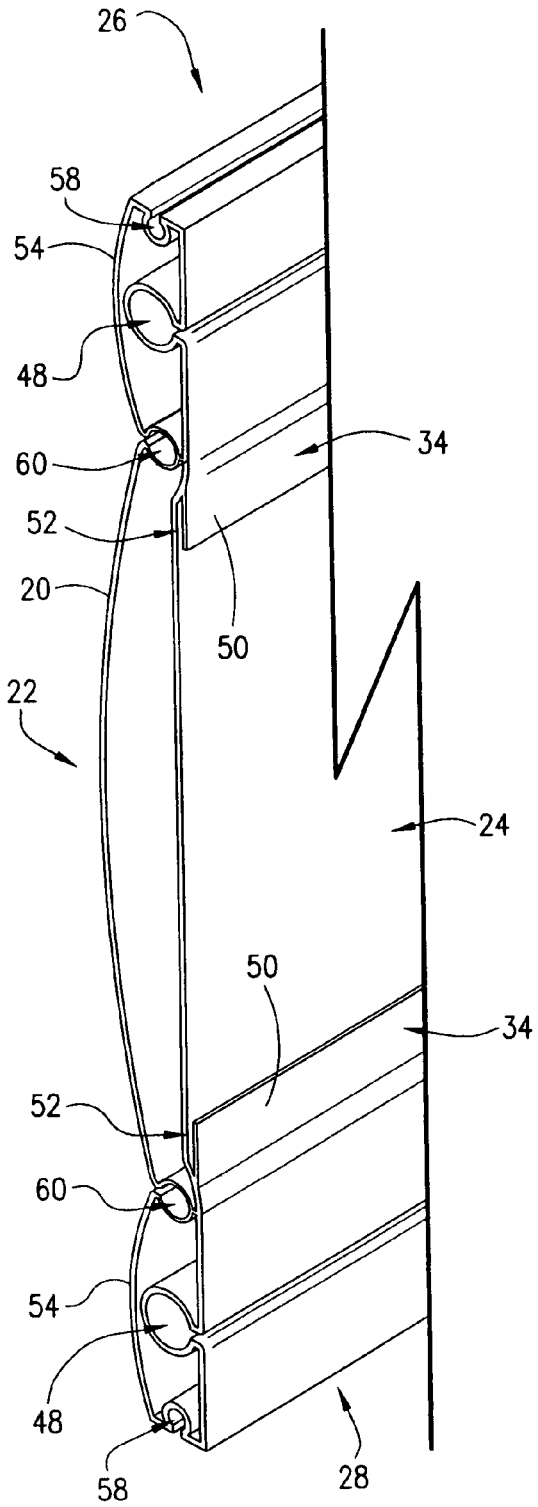
FIG. 5 is a schematic representation of a rear perspective view of a portion of a cornice system according to an embodiment.
Figure 6:
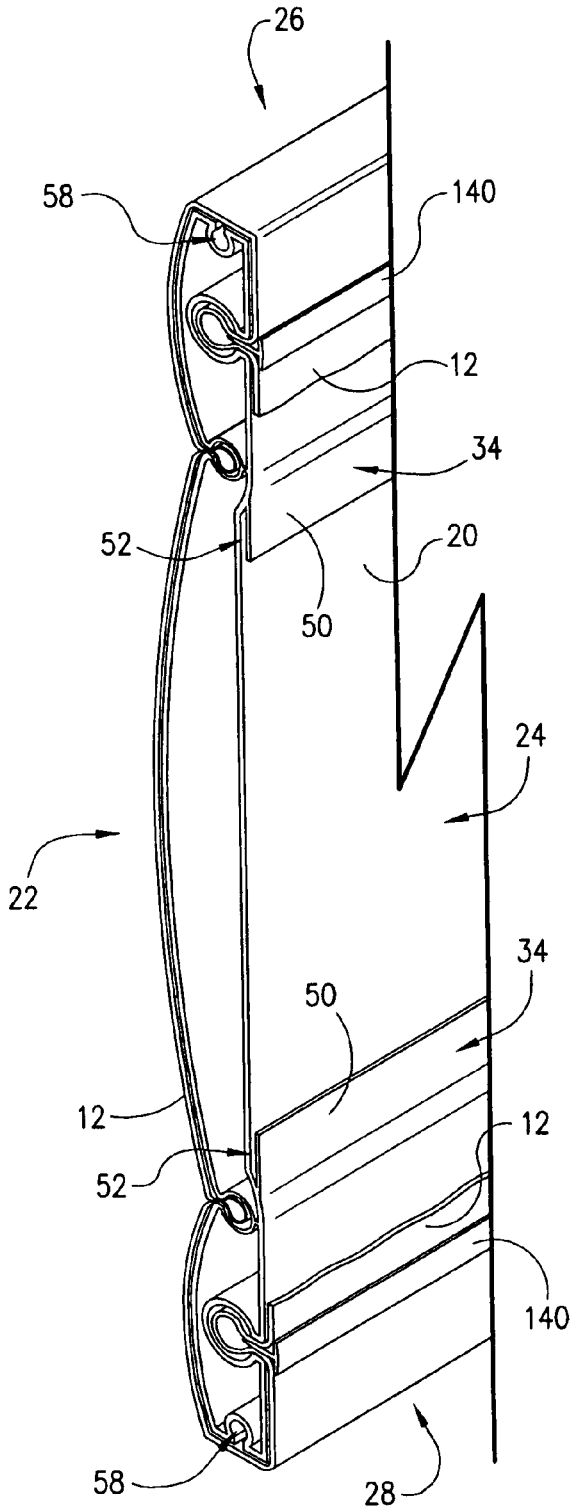
FIG. 6 is a schematic representation of a rear perspective view of a portion of the cornice system of FIG. 5 according to another embodiment.

Referring to FIGS. 4-6, face section(s) 20 are shown to include mounting members (e.g. shown as retainers 34, channels, grooves, slots, etc.) provided in the back of the face section, according to an exemplary embodiment. Retainers 34 are shown to include projections 50 (flaps, overlaps, extensions, tabs, etc.) extending generally parallel to back 24 of face section 20 to provide an elongated slot-like recess 52. The recess 52 of retainers 34 is intended to receive and retain a portion (e.g. leg 42) of bracket 36 that may be attached to the wall for mounting the assembled face sections and return sections to a desired location on the wall. The projection 50 of the retainer 34 is shown extending along the length of face section 20 and is intended to provide flexibility to a user in adjusting the position of the cornice relative to the wall. For example, leg 42 of the bracket 36 may be fitted into the recess 52, and then the cornice may be moved so that the face section "slides" over leg 42 to retain the cornice on the bracket in a relatively adjustable manner. The retainers are shown as being provided at two locations that are relatively symmetric along the back of the face section so that the face section may be installed in either of a first orientation (e.g. "right-side-up") or a second orientation (e.g. "upside-down"). The brackets are shown provided at spaced intervals along the retainer and are intended to mount the cornice to the mounting surface (e.g. wall, etc.) in a substantially secure manner and may be spaced at suitable intervals (e.g. 24 inches, 36 inches, etc.). The position of the cornice may be adjusted (e.g. moved, slid, etc.) in an "end-to-end" direction over the bracket with the leg behind the projection to provide flexibility in the installation of the cornice. The cornice may also be removed from the mounting surface by lifting the face section from the legs of the bracket and may be reinstalled by setting the face section on the brackets with the legs extending into the recesses.

Referring to FIGS. 1, 2, 5 and 6, the front of the face and return sections may be provided in various profiles or arrangements (e.g. shapes, contours, projections, protrusions, etc.). For example, the sections are shown schematically with two relatively narrow "arched" sections 54 adjacent to top 26 and bottom 28, and a relatively wide "arched" section 56 between the two narrow sections 54. The dimensions and proportions of the narrow and wide sections may be modified to provide any desired profile. According to an alternative embodiment, the front may be generally flat with an arch, projection or other suitable shape adjacent one or both of the top and bottom. Any other decorative profile or combination of shapes or contours (e.g. flat, arched, concave, convex, angled, recessed, etc.) may be provided in any desirable arrangement or pattern on the front of the section(s).

Referring to FIGS. 3A-3F and 4, trim members (e.g. aprons, shapes, profiles, etc.) may be connected to a top or bottom of the section(s) (shown schematically as connected to the bottom of the sections) according to an exemplary embodiment. The trim members are intended to provide an accessory that may be added to the cornice system by a user to modify, enhance or supplement the appearance of the cornice, according to any desired scheme or decorative plan. The trim members may be provided as a single piece in various lengths corresponding to the lengths of the face section (such as shown schematically, for example, in FIGS. 3A, 3D and 3E as trim members 100, 102 and 104). The trim members may also be provided in multiple segments having various shapes or patterns that may be provided along a portion of the face section(s) (such as shown schematically, for example, in FIGS. 3C, 3F and 4 as trim members 106, 108) or may be grouped in various combinations or sequences and extend along the length of the face section(s) (such as shown schematically, for example, in FIG. 3B as trim members 106 and 110). The trim members are shown as connectable to the face sections at any desired location. According to one embodiment, the trim members include connectors (shown schematically as projections 112 in FIG. 4) that are configured to be retained (e.g. snap-fit, sliding-fit, etc.) within openings 58 provided on the top and bottom of the face section(s). Openings 58 are shown having a generally cylindrical shape with an elongated slot-like opening configured to engage projections 112 to releasably interconnect the face section and the trim member. The openings are intended to permit the trim members to be installed on either the top or bottom of the face section(s). According to another embodiment, the trim members may be connected to the bottom of the sections and a relatively flat panel (not shown) may connected to the top of the face and/or return sections to provide a platform or "shelf" on the top of the cornice, such as for placement of ornamental or decorative objects or the like (e.g. knick-knacks, etc.).

Referring further to FIG. 4, the cornice further includes side panels 114 for use with the trim members, that may be connected to the return sections and/or the trim members. For example, the side panels are shown as having connectors in the form of tabs 116 that are configured to insert and "lock" within slots 92 on return section 70 (shown more particularly in FIG. 9). Slots 92 are shown as having variable width to receive a head of tab 116 and permit a body of tab 116 to slide into a locking section 94 of the slot 92 (as shown more particularly in FIG. 7). A shoulder 96 provides an interference fit intended to improve retention of the tab within the slot so that side panel 114 remains removably, yet substantially secured to return section 70. By further way of example, the side panels may be connected to the trim members by a tab 118 that is configured to be received (e.g. by sliding fit, interference fit, snap-fit, etc.) within an opening 120 formed by fingers 122 formed on the trim member (as shown more particularly in FIG. 8). According to alternative embodiments, the trim members and side panels may be connected to the face and return sections in any suitable manner (e.g. snap-fitting pieces, slide-fitting pieces, threaded fasteners, adhesives, two-sided tape, glue, hook-and-loop fasteners, etc.).

Referring to FIGS. 4-6 the face sections are provided with openings (e.g. channels, slots, grooves, etc.) at various locations on the back and/or the front for retaining cover materials according to an exemplary embodiment. The openings are shown formed in the substantially rigid sections to provide a relatively rigid (e.g. inflexible, nondeformable, etc.) slot-like opening leading to a cavity or space for receiving a cover material within. The openings are shown as two openings 60 located between center arched section 56 and end arched sections 54 on front 22 of face section 20 and two openings 48 located on back 24 proximate top 26 and bottom 28 of face section 20. The openings are shown schematically as having a generally circular body with a relatively narrow slot-like opening to provide access to the space within the opening. The openings may all be a substantially uniform size, or may have non-uniform sizes (as shown in FIGS. 5 and 6). The openings may be located on the sections to conform a cover material to the profile of the sections. For example, openings 60 are intended to conform a cover material over the contour of arched segments 54, 56 and openings 48 are intended to conform a cover material over the top and bottom of the section(s) (as shown more particularly in FIG. 6).

Referring further to FIG. 6, a cover material 12 is shown applied to section 20, where the cover material is retained within the openings to conform the material to the contour of the section. The size of the openings is intended to permit a suitable amount of a material to be retained (e.g. tucked, folded, stuffed, etc.) within the opening and also to permit additional items to be retained. For example, a first fabric may be applied over the entire section, and then a second fabric (e.g. contrasting, coordinating, etc.) may be applied over the center arched section and tucked within the openings between the arched sections. By further way of example, other accessories such as swags, shears, etc. (not shown) may be attached to openings 48 and permitted to "hang" from the back of the sections to provide a window treatment or other decorative feature. According to another example, a fabric may be applied over all, or a portion, of the section and a decorative lip cord (not shown) may be retained along with the fabric by the opening. According to any exemplary embodiment, the openings in the sections are intended to permit application of any desirable combination or arrangement of covering materials on the sections. According to alternative embodiments, the openings may have any suitable shape for holding a cover material (e.g. generally rectangular, triangular, tear-drop shaped, rectangular with "steps," etc.).

Referring to FIGS. 4 and 6 an insert member (shown as a T-strip 140) is provided according to an exemplary embodiment. T-strip 140 is shown having a length approximately equal to the length of the face section (or return section) and has a first portion configured to move (e.g. tuck, stuff, force, push, etc.) a quantity of a cover material into an opening along the face section (or return section). A user may apply the cover material over the section and retain the cover material within the openings by pressing the cover material into the opening with the T-strip. The T-strip has a second portion configured to "hold" the cover material in contact with the face portion adjacent the openings, in the event that the T-strip is left within the opening. The T-strip may be left in the opening after the cover material has been positioned in the opening (e.g. on openings on the back of the section that may face a wall or the like—such as shown in FIG. 6) or the T-strip may be removed from the opening after the fabric has been positioned in the opening (e.g. when the opening is on the face of the section, or when additional cover materials will be inserted through the slot such as contrasting fabrics, lip cording, etc.).

In a similar manner the cover material may be applied over the return sections and tucked into gaps 90, and may also be wrapped around an edge of second end 74 and secured with a holder (shown schematically as a clip 14 in FIG. 4). In the event that trim members are connected to the sections, a cover material may also be applied to the trim member and tucked within a gap 124 (with, or without a T-strip, or secured by a clip or the like) shown formed in the back portion of trim member 108.

T-strips may be omitted on the front when "simple" contours are used, or when the section is intended to be used with a coating (e.g. paint, stain, etc.), or wallpaper or when no cover material is used. The insert members are intended to facilitate installation and/or retention of one or more of a variety of cover materials (e.g. fabrics, textiles, complimentary or contrasting fabrics, etc.) or accessories (e.g. sheers, swags, lip cords, etc.) that may be used for window coverings or other decorative accessories within the openings. The insert members on the front may be positioned to conform a cover material to a particular contour on the front. The insert members on the back may be positioned to hold the ends of the cover material over the top and bottom to present a "neat" appearance on the top, bottom and front. The insert members on the back are also intended to permit application of a lining on the back when the back of the section is visible (e.g. through a window, etc.) and to conform the cover material to a contour on the front by tucking the cover material into the openings. For example, a fabric may be retained against the contour on the front by tucking the fabric into the openings on the front, and the ends of the fabric may be tucked into the openings on the back to provide a "neat" or otherwise "finished" appearance. A decorative accessory (e.g. lip cord, etc.) may also be positioned on the fabric and tucked with the fabric into an opening on the front to provide a decorative contrast. Other accessories (e.g. a shear, a swag, etc.) may be positioned on the fabric on the back and tucked with the fabric into an opening on the back to provide a window covering, treatment or other decorative feature or ornamental appearance. The cover material may be readily removed and/or replaced by removing the T-strip (if necessary) and "pulling" or otherwise removing the cover material from the openings (such as, for example, modifying or updating an existing decorative appearance, for cleaning or replacing cover materials, for accessorizing at festive occasions such as holidays or significant events or occasions, etc.).

According to an alternative embodiment, a T-strip may be omitted and other objects or devices may be used to install a cover material within the openings. For example, any simple and readily available object or tool with a relatively "thin" edge (e.g. a card such as a "credit-card," ordinary table knife, pizza-cutter, etc.) may be used to tuck the material into the opening(s).

According to another alternative embodiment, the openings may be configured to receive and hold a separate gripping insert intended to retain the cover material within the openings (e.g. by gripping, holding, pinching, etc.). The gripping insert may be retained within the recess by a "snap-in" fit, press fit, interference fit, frictional fit, or may slide in from an end of the section, etc. Such gripping inserts may be held by hook-and-loop type fasteners, adhesive, glue, threaded fasteners, etc. The gripping insert may be made of any suitable material to permit easy installation and secure retention of cover materials. The material for the gripping insert is also intended to permit removal of the cover materials without significant damage to permit a user to interchange cover materials (e.g. holiday decorating, seasonal changes, replacement of worn cover materials, etc.). Such gripping inserts maybe made of a resilient or compliant material such as rubber that serves to hold the cover materials. Other materials may be used for the gripping insert, such as dense foam, "hooks" from a hook-and-loop fastener (e.g. Velcro®, etc.), or intertwined projections (e.g. "spikes", etc.). According to any alternative embodiment, the gripping insert is intended to permit the cover materials to be interchangeable with the cornice (e.g. for changes in decorating schemes, replacement of damaged or worn cover material, and the like).

According to any exemplary embodiment, the manufacturing process for the sections of the cornice is intended to be flexible to provide sections for the cornice system in a wide variety of shapes, profiles, and sizes. According to one embodiment, the face sections of the cornice are made from a lightweight material (e.g. a plastic material such as a rigid polyvinyl chloride (PVC)) in an extrusion process that provides a substantially "hollow" cross-sectional shape having the openings and retainers as shown generally in FIGS. 5 and 6. The return sections are also made from a lightweight material (such as PVC) in a molding process sufficient to provide the connectors and other structures shown for example in FIGS. 4 and 9. The sections may be formed (e.g. extruded, molded, etc.) in any of a wide variety of colors by using suitable dyes or coloring agents in the forming process. Such colors may be provided in variety of "decorator" type colors for selection by consumers. According to a preferred embodiment, the thickness of the material for the sections is within the range of approximately 3/32 inch to 1/16 inch, but may be any suitable thickness to provide the desired strength and lightweight characteristics of the cornice, based on any particular material. According to an alternative embodiment, the face section may have a generally "open" back with one or more recesses that may have rigidifications (e.g. ribs, gussets, etc.) to maintain the shape and rigidity of the cornice system. According to another alternative embodiment, the sections may be formed having a generally "solid" cross section, or may have a portion that is hollow and another portion that is solid. According to a further alternative embodiment, the sections may be made from other materials (e.g. foam, Styrofoam®, poly-foam, triple-ply cardboard, wood, metal, or a suitable combination thereof). The surface of the material for the sections is intended to be formed with an exterior finish that is "textured" (e.g., matte, etc.) and/or provided in a generally "neutral" color that permits the cornice system to be used uncovered, or covered (or partially covered) with any one of a combination of cover materials (e.g. fabric, wallpaper, paint, stain, appliqués (e.g. "stick-ups," "wallies," etc.)) or treatments to customize or stylize a particular application or motif. According to an alternative embodiment, the sections may be formed with certain "corrugations" or other structure (such as scoring, weakened areas, cutting lines, etc.) intended to be easily customized by a user (such as by cutting-out or breaking-off certain desired portions, etc.).

According to any preferred embodiment, the sections and trim members may be assembled with the connectors into a cornice having any suitable configuration desired by a user for a particular application. For example, one or more face sections in any suitable length may be combined with one or more return sections having any suitable length and one or more trim members to provide a modular, customized structure for a cornice. The sections and/or trim members of the cornice system may be used with a cover material (or any desirable combination of cover materials) or without a cover material. For example, one or more cover materials may be applied to a portion or all of the cornice system to suit a desired decorating scheme. Cover materials or treatments such as wallpaper, paint, stain, etc. may be applied directly to the exterior (e.g. textured) surface of the sections. Other cover materials (such as fabrics, textiles, etc.) and accessories (such as lip cords, shears, swags, etc.) may be applied by insertion of a portion of the cover materials and/or accessories into the openings. Any suitable combination of cover materials (e.g. color, shape, quantity, size, type, etc.) may be used in any suitable pattern on all or a portion of the sections of the cornice. The cover materials and accessories may be interchanged or replaced or modified to suit changes to a decorating scheme desired by a user (e.g. on a periodic or other basis, such as redecorating of a space). The sections and trim members of the cornice may also be used without a cover material and may be provided in one or a variety of colors.

The components of the cornice are intended to be available as a commercial product that includes any combination of sections, connectors, trim members, T-strips, mounting components and related hardware (e.g. fasteners, etc.), tools and instructions (e.g. instruction booklet, brochure, manual, video, compact disc (CD), etc.) for assembly of the sections, application of cover materials and accessories, and mounting of the cornice system. Such items of the cornice may be provided in a variety of do-it-yourself type "kits" (e.g. of a prepackaged type, etc.) or may be provided in "bulk" quantities at a home-improvement store or the like that are intended to permit a consumer to customize or "pick and choose" certain items intended for assembly into a completed cornice and other items such as face sections, T-strips, etc. may be provided in extended lengths that may be "cut-to-suit" at the request of a consumer. The components of the cornice are also intended to be "user friendly" in that some of the components are substantially symmetrical and may be installed upside-down or right-side-up, and may be repositioned along the brackets without repositioning the brackets on the wall. The components are also intended to be readily connected (e.g. snap-fit together) in a manner that may also be readily disassembled. The components are provided in modular form and may be "mixed-and-matched" in a wide variety of configurations and combinations to suit any desired application, installation or decorating scheme. The cornice is intended to provide an easy-to-assemble system that is readily useable in residential applications by homemakers, crafters, etc. (e.g. for one or several applications such as in a home) and also for commercial applications such as by contractors, decorating professionals, etc. (e.g. for multiple, or large installations, such as hospitals, hotels, office buildings, etc.)

It is also important to note that the construction and arrangement of the elements of the cornice as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes, profiles and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the connectors, openings, mounting members, brackets, etc. may be reversed or otherwise varied, the length or width of the structures and/or members, mounting brackets, connectors, trim members, or other elements of the cornice may be varied. Further the size, contour, nature or number of sections provided in the cornice system may be varied. It should be noted that the sections, trim members and connectors of the cornice may be constructed from any of a wide variety of materials that provide sufficient strength or durability, in any of a wide variety of colors, textures and combinations. It should also be noted that the cornice system may be used in association with a wide variety of other applications (e.g. display borders, frames, headboards, etc.) and that cover materials for the cornice may be any suitable material that provides a creates a desired appearance for the cornice system (e.g. decorative, contrasting, accessorized, etc.). Further, various combinations of cover materials may be used with the cornice system or portions of the cornice to provide a wide variety of customized looks. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A cornice, comprising:

at least one substantially rigid and planar front section having an outwardly disposed top edge and an outwardly disposed bottom edge, the top edge and the bottom edge having one of a projection and an opening, and the front section having a back and an opposing face, the face having at least one contoured surface;

at least one substantially planar accessory panel having the other of the projection and the opening connectable to at least one of the top edge and the bottom edge of the front section by engagement of the projection and the opening so that the substantially planar accessory panel extends co-planar and outwardly from the front section; and at least one slot extending at least partially along the face of the front section and retaining a flexible cover material applied over at least a portion of the face.

2. The cornice of claim 1 wherein the cover material comprises one or more fabric or textile materials.

3. The cornice of claim 1 wherein the accessory panel comprises a plurality of accessory panel segments.

4. The cornice of claim 1, further comprising at least one flap projecting from the back and extending substantially parallel to the back, the flap configured to engage a mounting bracket.

5. The cornice of claim 1 further comprising at least one slot extending at least partially along a length of the back, the slot providing access to an elongated recess configured to receive and retain the cover material.

6. The cornice of claim 1 wherein the face comprises a textured surface.

7. The cornice of claim 1, further comprising:

at least one enclosed hollow region defined within the front section;

at least one return panel for coupling to an end of the front section; and a connector coupling the return panel to the front section, the connector comprising at least one tab that fits within the hollow region and engages an inner surface of the face and the back.

8. The cornice of claim 7 wherein at least one of the front section and the return panel are formed from a plastic material.

9. The cornice of claim 7 wherein the tab comprises two planar tabs extending parallel to one another.

10. The cornice of claim 9 wherein the tabs are configured to provide support within the hollow region to maintain a shape of the contoured surface.

11. The cornice of claim 7 wherein the hollow region comprises an upper hollow region, a central hollow region, and a lower hollow region.

12. The cornice of claim 11 wherein the tab fits within the central hollow region.

13. The cornice of claim 1 wherein the cover material comprises at least one of wallpaper and textured paint.

14. The cornice of claim 1 wherein the substantially rigid front section is formed in one or more colors for creating a decorative appearance in the absence of a cover material.

15. The cornice of claim 1 wherein the front section comprises a foam material.

16. The cornice of claim 12 wherein the tab is configured to provide support within the central hollow region to maintain a shape of the contoured surface.

* * * * *